US012117203B2

(12) United States Patent
Knoblett et al.

(10) Patent No.: US 12,117,203 B2
(45) Date of Patent: Oct. 15, 2024

(54) HYBRID WATER HEATER WITH ADAPTIVE TEMPERATURE CONTROL

(71) Applicant: Rinnai America Corporation, Peachtree City, GA (US)

(72) Inventors: Michael Scott Knoblett, Newnan, GA (US); Scott Gilman Humphrey, Newnan, GA (US)

(73) Assignee: Rinnai America Corporation, Peachtree City, GA (US)

( * ) Notice: Subject to any disclaimer, the term of this patent is extended or adjusted under 35 U.S.C. 154(b) by 89 days.

(21) Appl. No.: 18/073,796

(22) Filed: Dec. 2, 2022

(65) Prior Publication Data

US 2023/0175736 A1 Jun. 8, 2023

Related U.S. Application Data

(60) Provisional application No. 63/285,529, filed on Dec. 3, 2021.

(51) Int. Cl.

| | |
|---|---|
| ***F24H 15/175*** | (2022.01) |
| ***F24H 1/12*** | (2022.01) |
| ***F24H 15/223*** | (2022.01) |
| ***F24H 15/335*** | (2022.01) |

(52) U.S. Cl.

CPC ..... *F24H 15/175* (2022.01); *F24H 1/122* (2013.01); *F24H 15/223* (2022.01); *F24H 15/335* (2022.01)

(58) Field of Classification Search

CPC ..... F24H 15/223; F24H 15/175; F24H 1/122; F24H 9/2021; F24D 17/0031; F24D 19/1051

See application file for complete search history.

(56) References Cited

U.S. PATENT DOCUMENTS

| | | | | |
|---|---|---|---|---|
| 5,056,712 | A * | 10/1991 | Enck | G05D 23/1904 236/47 |
| 10,330,344 | B2 * | 6/2019 | Teng | F24H 15/225 |
| 11,421,915 | B2 | 8/2022 | Oliver et al. | |
| 11,649,985 | B2 * | 5/2023 | Dettmering | F24D 17/0036 122/13.3 |
| 11,867,429 | B2 * | 1/2024 | Humphrey | F24D 17/0031 |
| 2022/0196292 | A1 * | 6/2022 | Knoblett | H04L 12/2823 |

* cited by examiner

*Primary Examiner* — Gregory A Wilson
(74) *Attorney, Agent, or Firm* — Quinn IP Law

(57) ABSTRACT

A hybrid water heater incudes a storage tank, a first temperature sensor, a tankless heater fluidly coupled to the storage tank, and a controller configured to determine a target output temperature range for the tankless heater based on a temperature setpoint, measure a temperature of hot water stored in an upper portion of the storage tank using the first temperature sensor, determine whether the measured temperature of the hot water is less than a first minimum temperature setpoint, generate an adjusted target output temperature range for the tankless heater based on a determination that the measured temperature is less than the first minimum temperature by increasing a value of both the lower threshold and the upper threshold, and control the tankless heater to produce the heated water according to the adjusted target output temperature range.

20 Claims, 8 Drawing Sheets

HYBRID WATER HEATER WITH ADAPTIVE TEMPERATURE CONTROL

CROSS-REFERENCE TO RELATED APPLICATIONS

This application claims priority to and the benefit of U.S. Provisional Patent Application No. 63/285,529, filed Dec. 3, 2021, which is incorporated herein by reference in its entirety.

BACKGROUND

The present disclosure relates generally to water heaters which, at a high level, operate by transferring thermal energy between one or more heating elements and water, thereby heating the water to a desired setpoint. Water heaters are often used in both residential and commercial plumbing networks, which may require water to be continuously circulated into a heating device to maintain a desired water temperature in hot-water supply lines.

Traditional water heaters, also referred to herein as storage tank water heaters, can include a storage tank that holds a set amount of water (e.g., 40 gallons) and either gas or electric heating elements that heats the water in the storage tank to a setpoint temperature (e.g., 135° F.). While often inexpensive upfront, storage tank water heaters may come with increased operating costs due to the inefficiencies of heating and/or maintaining heat in such a large mass of water. Additionally, storage tank water heaters may struggle to keep up with periods of increased demand. For example, the water heater's tank may be quickly emptied if multiple people in a household use hot water at the same time (e.g., when showering in the morning) and replenishing the hot water requires heating the entire mass of the storage tank.

Tankless water heaters may address some of the issues of storage tank water heaters by heating water on-demand. For example, a tankless water heater may heat about two to five gallons of water per minute, which can be provided directly to a user as needed. In this manner, tankless water heaters may be more efficient than storage tank water heaters because they heat smaller amounts of water and typically do not need to reheat a large mass of water in a storage tank. However, tankless heaters may struggle to keep up with transient hot water demands and may not efficiently utilize recirculated water from external plumbing system. Additionally, it can be difficult to maintain an output water temperature of both storage tank and tankless style water heaters due to the variability of water usage in both residential and commercial applications.

SUMMARY

One implementation of the present disclosure is a system for heating water that includes a storage tank having a lower portion and an upper portion, the lower portion including a first inlet for receiving water from a source and the upper portion including a first outlet for providing hot water to a building system, a first temperature sensor positioned in the upper portion of the storage tank, a tankless heater for producing heated water and providing the heated water to the upper portion of the storage tank, the tankless heater including a second outlet for fluidly coupling the tankless heater to the storage tank, and a controller configured to determine a target output temperature range for the tankless heater based on a temperature setpoint, the target output temperature range including a lower threshold that is less than the temperature setpoint and an upper threshold that is greater than the temperature setpoint, measure a temperature of the hot water stored in the upper portion of the storage tank using the first temperature sensor, determine whether the measured temperature of the hot water is less than a first minimum temperature, generate an adjusted target output temperature range for the tankless heater based on a determination that the measured temperature is less than the first minimum temperature by increasing a value of both the lower threshold and the upper threshold, and control the tankless heater to produce the heated water according to the adjusted target output temperature range.

In some embodiments, the system further includes a pump positioned between the storage tank and the tankless heater, the pump configured to transfer the cold water from the lower portion of the storage tank to the tankless heater.

In some embodiments, the system further includes a second temperature sensor positioned in the lower portion of the storage tank, the controller further configured to measure a water temperature in the lower portion of the storage tank using the second temperature sensor and activate the pump responsive to a determination that the water temperature in the lower portion of the storage tank is below a second minimum temperature, a value of the first minimum temperature being lower than a value of the second minimum temperature.

In some embodiments, the first inlet of the storage tank is configured to receive recirculated water from the building system such that the recirculated water mixes with the hot water stored in the storage tank and the water received from the source.

In some embodiments, the lower threshold of the adjusted target output temperature range is between 10 and 20° F. less than the temperature setpoint and the upper threshold of the adjusted target output temperature range is between 10 and 20° F. greater than the temperature setpoint.

In some embodiments, the controller is further configured to calculate the first minimum temperature by subtracting a predefined temperature variable from the temperature setpoint.

In some embodiments, the system further includes a user interface for receiving a user input defining the temperature setpoint.

In some embodiments, the tankless heater further includes a second inlet for receiving the cold water from the lower portion of the storage tank.

In some embodiments, the tankless heater is mounted to an exterior surface of the storage tank.

Another implementation of the present disclosure is a method for controlling a hybrid water heater including a storage tank for holding water and a tankless heater fluidly coupled to the storage tank for producing heated water. The method includes determining a target output water temperature range for the tankless heater based on a temperature setpoint, the target output water temperature range including a lower threshold that is less than the temperature setpoint and an upper threshold that is greater than the temperature setpoint, measuring, by a first temperature sensor positioned in an upper portion of the storage tank, a temperature of water stored in the upper portion of the storage tank, determining whether the measured temperature of the water is less than a first minimum temperature, generating an adjusted water target output temperature range for the tankless heater based on a determination that the measured temperature is less than the first minimum temperature by increasing a value of both the lower threshold and the upper threshold, and operating the tankless heater to produce the heated water according to the adjusted target output water temperature range.

In some embodiments, the hybrid water heater further includes a pump positioned between the storage tank and the tankless heater, the pump configured to transfer the water from a lower portion of the storage tank to the tankless heater.

In some embodiments, the method further includes measuring, by a second temperature sensor positioned in the lower portion of the storage tank, a water temperature in the lower portion of the storage tank and activating the pump responsive to a determination that the water temperature in the lower portion of the storage tank is below a second minimum temperature, a value of the first minimum temperature being lower than a value of the second minimum temperature.

In some embodiments, the method further includes receiving, by the storage tank, recirculated water from an external plumbing system such that the recirculated water mixes with the water stored in the storage tank and water received from a source.

In some embodiments, the lower threshold of the adjusted target output water temperature range is between 10 and 20° F. less than the temperature setpoint and the upper threshold of the adjusted target output water temperature range is between 10 and 20° F. greater than the temperature setpoint.

In some embodiments, the method further includes calculating the first minimum temperature by subtracting a predefined temperature variable from the temperature setpoint.

In some embodiments, the method further includes receiving, from a user interface, a user input defining the temperature setpoint.

Yet another implementation of the present disclosure is a water heater that includes a storage tank for holding water, the storage tank having a lower portion and an upper portion, a tankless heater configured to produce heated water and to provide the heater water to the upper portion of the storage tank, the tankless heater positioned externally to the storage tank, a first temperature sensor configured to measure a temperature of the water in the upper portion of the storage tank, and a controller configured to measure the temperature of the water stored in the upper portion of the storage tank using the first temperature sensor, determine a target output water temperature range for the tankless heater based on the measure temperature, the target water output temperature range including i) a first lower threshold and a first upper threshold if the measured temperature is above a first minimum temperature, or ii) a second lower threshold and a second upper threshold if the measured temperature is at or below the first minimum temperature, a value of the second lower threshold being less than a value of first lower threshold and a value of the second upper threshold is greater than a value of the first upper threshold, and operate the tankless heater to produce the heated water according to the target output water temperature range In some embodiments, the water heater further includes a second temperature sensor configured to measure a temperature of the water in the lower portion of the storage tank and a pump configured to transfer the water from the lower portion of the storage tank through the tankless heater.

In some embodiments, the controller is further configured to measure a water temperature in the lower portion of the storage tank using the second temperature sensor and activate the pump responsive to a determination that the water temperature in the lower portion of the storage tank is below a second minimum temperature, a value of the first minimum temperature being lower than a value of the second minimum temperature.

In some embodiments, the second lower threshold of the target output water temperature range is between 10 and 20° F. less than a temperature setpoint and the second upper threshold of the target output water temperature range is between 10 and 20° F. greater than a temperature setpoint.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Figure 1A:
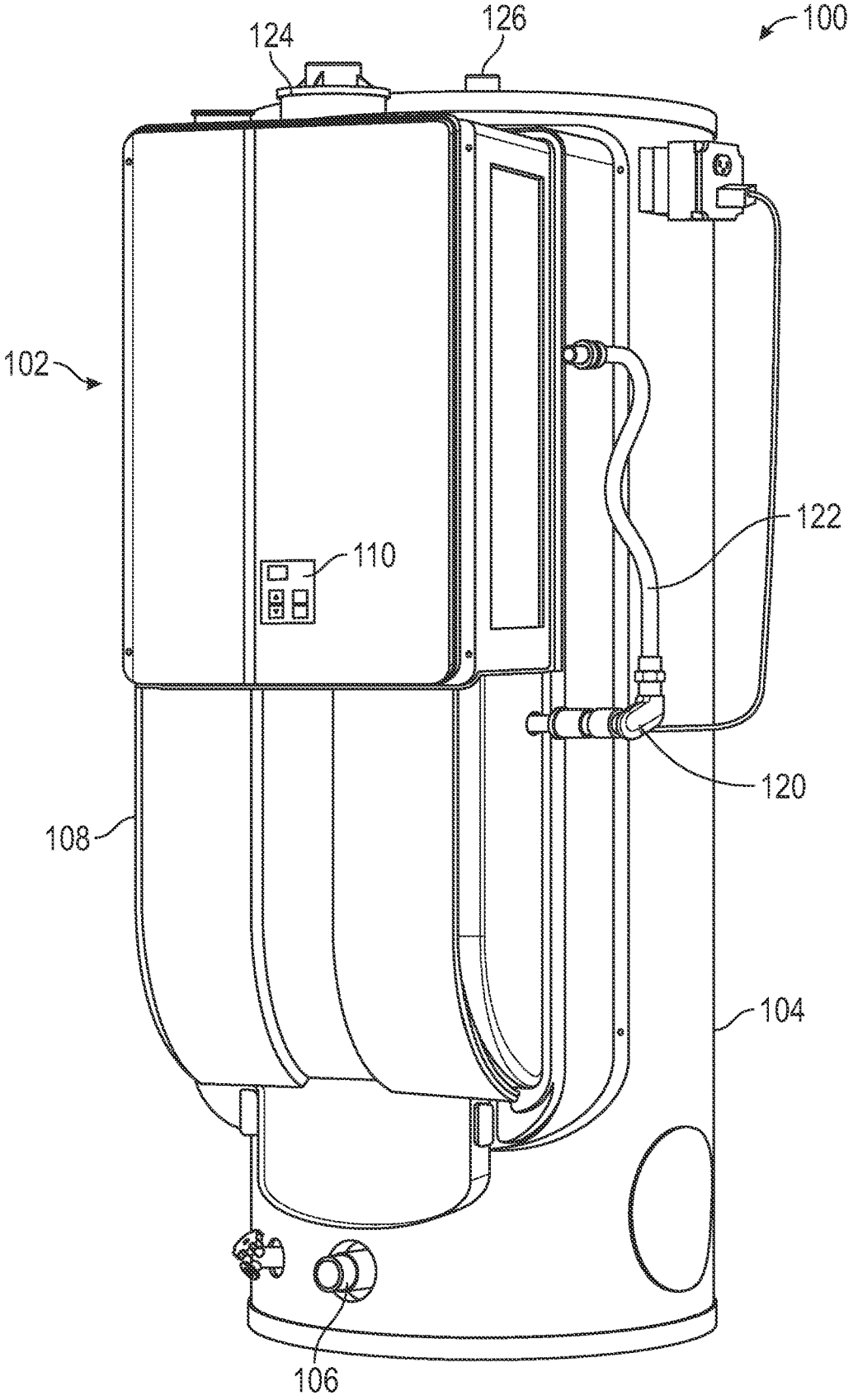
FIG. 1A is a perspective view of an example hybrid water heater, according to some embodiments.

Referring generally to the FIGURES, a hybrid water heating system having both a water storage tank and a tankless heater is shown, according to various embodiments. In particular, the hybrid water heating system described herein may include a storage tank for receiving cold (i.e., unheated) water from a source, such as a building or municipal water supply, as well as for holding heated water provided by the tankless heater. Likewise, the tankless heater may be configured to receive cold water from the storage tank, heat the water to a desired temperature setpoint, and provide the heated water to the storage tank for holding. In this manner, the hybrid water heating system may address many of the disadvantages of traditional storage tank water heaters and tankless water heaters.

As an example, the hybrid water heating system can store heated water in the storage tank to meet transient hot water demands that a tankless water heater alone may struggle to fulfill. Additionally, the storage tank may be configured to receive recirculated water from external building systems (e.g., a plumbing system), which may be at higher initial temperature than water received from other sources, such as a water utility. The recirculated water may mix with the cold water stored in the storage tank and/or received from a source, raising the temperature of the entire mass of water in the storage tank and thereby requiring less energy to heat the water to a temperature setpoint. Along similar lines, the tankless heater may use less energy to heat water than a traditional storage tank water heater because the tankless heater is not required to heat a large mass of water (e.g., 40 gallons) to maintain a desired temperature. Rather, the tankless heater may operate on-demand to heat small amounts of water quickly, which can then be transferred to the storage tank.

As briefly mentioned above, it can be difficult to ensure that the hybrid water heating system provides water to external systems at a consistent temperature that meets a desired temperature setpoint. For example, the mixing of cold water from a source with recirculated water from the external system in the storage tank can lead to variations in the initial temperature of water being heated by the tankless heater. Additionally, in periods of high demand, water may be transferred out of the storage tank more quickly than it can be replenished by the tankless heater using conventional control methods. For example, it may be undesirable for the tankless heater to merely heat water at its maximum energy output to meet increased demand, which could lead to overheating of the water provided to the external system. Rather, the tankless heater may need to modulate the amount of energy used to heat the water to prevent overheating.

The hybrid water heating system and corresponding methods disclosed herein address these issues, particularly in implementations where recirculated water is received from external systems, by allowing the tankless heater to overshoot an output temperature setpoint to meet increased hot water demands. Under normal conditions, for example, the tankless heater may be allowed a certain degree of error in its output water temperature. In other words, the output water temperature of the tankless heater may be considered to meet the output water temperature setpoint if it is within a threshold (e.g., ±2° F.) of the setpoint.

Under certain other conditions, such as periods of increased demand, the allowable temperature range at the output of the tankless heater may be increased (e.g., widened) to allow the tankless heater to "overheat" the water compared to the normal conditions. For example, the output water temperature of the tankless heater may be allowed to reach ±10° F. of the setpoint. In this manner, the "overheated" water can blend with cooler water stored in the storage tank to more accurately and consistently meet the output temperature setpoint for the hybrid water heating system. Additional features and advantages of the hybrid water heating system and methods are described in greater detail below.

Hybrid Water Heater

Figure 1B:
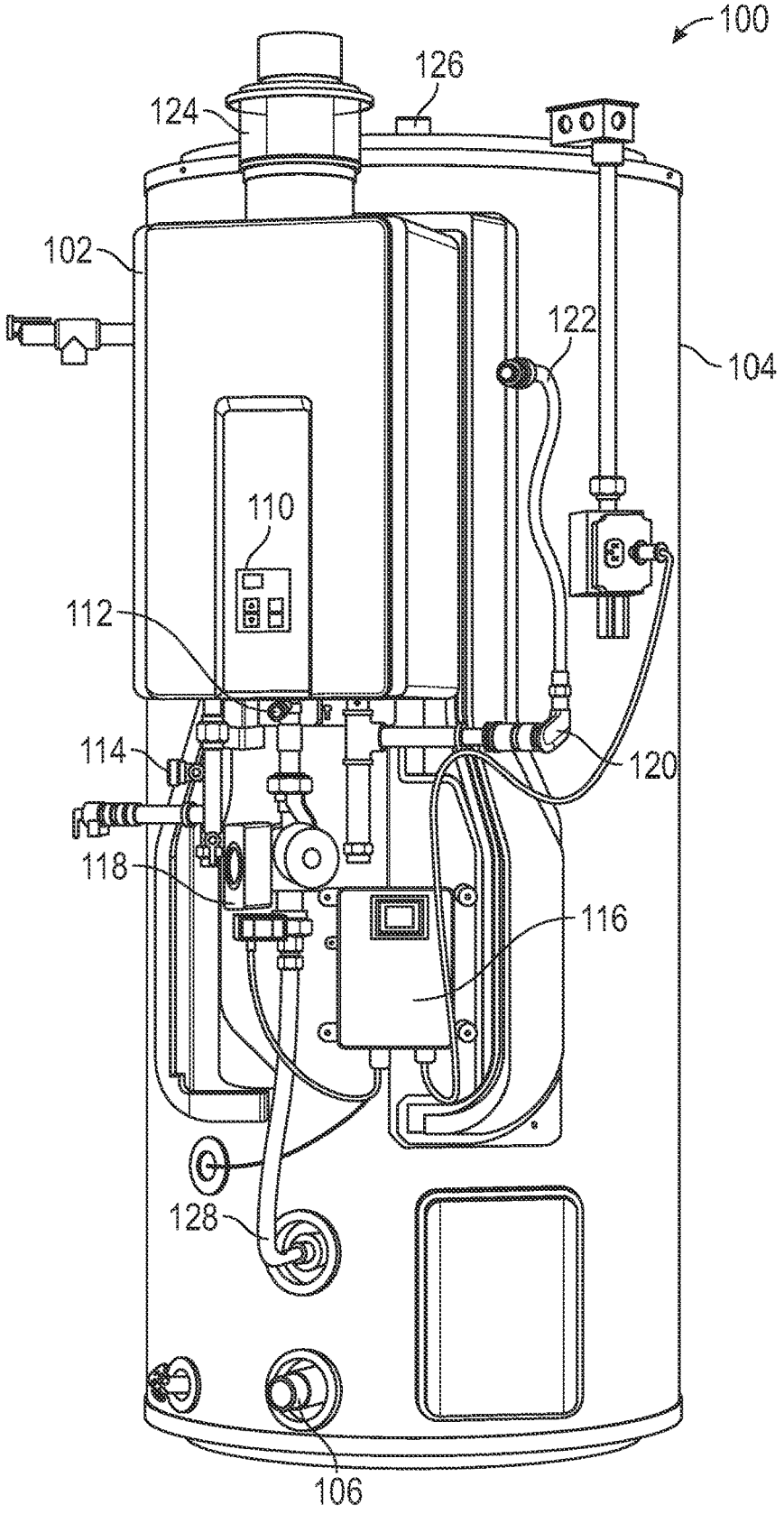
FIG. 1B is a perspective view of the example hybrid water heater of FIG. 1 having a front cover removed, according to some embodiments.

Turning first to FIGS. 1A and 1B, perspective views of an example hybrid water heater 100 are shown, according to some embodiments. In particular, FIG. 1A shows a perspective view of hybrid water heater 100 having a front cover 108 installed, while FIG. 1B shows hybrid water heater 100 with front cover 108 removed. As shown, front cover 108 may be removably mounted to hybrid water heater 100 to cover various components, including a tankless heater 102, described in greater detail below. Hybrid water heater 100 also includes a water storage tank 104 having a cold water inlet 106 for receiving cold water from a source, such as a municipal water supply or other water utility. Cold water, as described herein, may refer to any water that has not yet been heated by tankless heater 102. Accordingly, it will be appreciated that "cold" water may refer to water at a wide range of temperatures; however, while not intended to be limiting, cold water may generally be at or below room temperature (e.g., 72° F.). As described in greater detail below with respect to FIG. 2, storage tank 104 may have a lower portion for receiving and/or storing cold water and an upper portion for receiving and/or storing heated water.

As shown in FIG. 1B, storage tank 104 may include a cold water outlet 128 for supplying cold water maintained within the storage tank 104 to tankless heater 102. Cold water outlet 128 may be positioned above cold water inlet 106 and toward the bottom of the hot water storage tank 104 (i.e., in the lower portion of storage tank 104). In some embodiments, a recovery pump 118 may be configured to pump water from cold water outlet 128 to a cold water inlet 112 of tankless heater 102. Accordingly, recovery pump 118 may be any pump capable of moving water, such as a centrifugal pump, a positive displacement pump, a peristaltic pump, or any other suitable type of pump. In some embodiments, recovery pump 118 may be sized based on a desired or maximum flow rate (e.g., in gallons per minute (GPM)) for tankless heater 102. For example, if tankless water heater is configured to heat water at an average of 4.0 GPM, then recovery pump 118 may be sized to move at least 4.0 GPM.

Water circulated by recovery pump 118 is heated by tankless heater 102 using one or more heating elements provided to storage tank 104 via a first hot water outlet 114 of tankless heater 102. Hot water outlet 114 may be in fluid communication with a hot water inlet in the upper portion of storage tank 104 (not shown) such that the heated water may be transferred into an upper portion of storage tank 104. A second hot water outlet 126 may be positioned on a top surface of storage tank 104 to supply heated water from storage tank 104 to an external plumbing network (e.g., of a residential or commercial building).

In embodiments where tankless heater 102 heats water using gas burners rather than electrical element, hybrid water heater 100 can include a flex pipe 122 for carrying a fuel (e.g., natural gas, propane, etc.) to tankless heater 102. For example, flex pipe 122 may be coupled to a fuel source (e.g., a gas line from a utility company) on one end and to a swivel connector 120 on the other. Swivel connector 120 may provide some degree of rotation (e.g., up to 360°) for flex pipe 122 while maintain a secure connection with a fuel inlet of tankless heater 102 (not shown). As shown in FIG. 1A, in some embodiments, one or both of flex pipe 122 and swivel connector 120 may be positioned outside of front cover 108 when installed. In other embodiments, such as when tankless heater 102 includes electrical heating elements for heating water, hybrid water heater 100 may not include one or both of flex pipe 122 and swivel connector 120.

In some embodiments, tankless heater 102 includes a coaxial air intake and/or exhaust vent 124 for receiving intake air and expelling exhaust. Vent 124 can expel exhaust from a central exhaust pathway (not shown) and receive air from a circumferential air intake pathway (not shown). In some embodiments, vent 124 also includes a vent attachment that facilitates connection of the coaxial intake air and exhaust port to a Category 1 vent, such as a B-vent. At the same time, the vent attachment may facilitate air intake from an ambient environment surrounding the hybrid water heating system 100 through a mesh frame. The vent and intake system for tankless heater 102, including vent 124, is described in greater detail in U.S. patent application Ser. No. 17/162,851, filed on Jan. 29, 2021, which is incorporated herein by reference in its entirety.

Still referring to FIG. 1B, hybrid water heater 100 may also include a controller 116. As shown, controller 116 may be electronically coupled to one or more components of hybrid water heater 100, including tankless heater 102 and recovery pump 118. Controller 116 may be configured to receive data from tankless heater 102 and/or recovery pump 118 and may also provide control signals to one or both of tankless heater 102 and recovery pump 118. For example, controller 116 may receive data indicating a speed of recovery pump 118 and/or may command recovery pump 118 to turn on or operate at various speeds. Additionally, as described in greater detail below with respect to FIG. 3, controller 116 may receive data from one or more sensors positioned at various points on hybrid water heater 100.

In some embodiments, tankless heater 102 also includes a user interface 110. User interface 110 may be positioned at any point on hybrid water heater 100 and/or may be a device that is external to hybrid water heater 100. As shown in FIGS. 1A and 1B, for example, user interface 110 may be positioned on an exterior surface of tankless heater 102 and/or may be positioned such that user interface 110 is accessible with front cover 108 installed. As another example, user interface 110 is not physically attached to hybrid water heater 100 but is instead implemented on a separate device, such as a workstation, a mobile device (e.g., a smartphone or laptop), or any other computing device. In general, user interface 110 includes a display (e.g., LCD, LED, etc.) for presenting information to a user and, in some embodiments, can include a user input device (e.g., a keypad, a keyboard, a touchscreen, physical buttons, etc.) for receiving user inputs. In the example shown, user interface 110 includes a small LCD display and multiple buttons that allow the user to make selections, adjust parameters, and the like.

Figure 2:
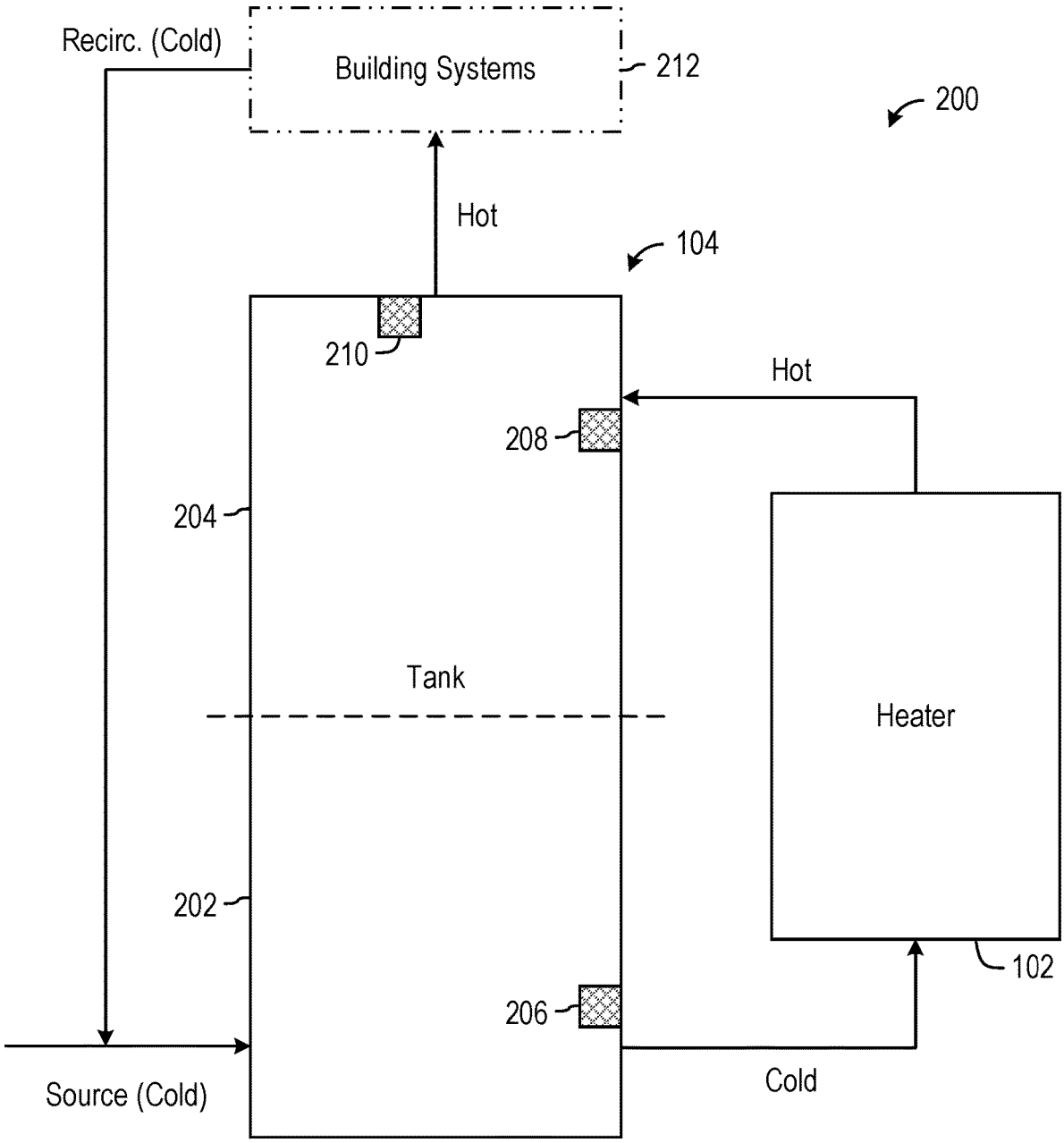
FIG. 2 is a diagram of a hybrid water heating system, according to some embodiments.

Referring now to FIG. 2, a diagram of a hybrid water heating system 200 is shown, according to some embodiments. System 200 is shown to include tankless heater 102 and storage tank 104, as described above. Accordingly, in some regards, system 200 may represent a water heating system that includes hybrid water heater 100. As shown, storage tank 104 can include a lower portion 202 and an upper portion 204. As described herein, lower portion 202 may be generally defined as the bottom half (i.e., the lower 50%) of storage tank 104 and upper portion 204 may be generally defined as the top half (i.e., the upper 50%) of storage tank 104; although, it will be appreciated that one of lower portion 202 or upper portion 204 may constitute slightly more of the total volume of storage tank 104. For example, upper portion 204 may be defined as the top 55% of storage tank 104 depending on the construction of storage tank 104. However, lower portion 202 and upper portion 204 may generally be within a 10% threshold of half (i.e., 50%) of storage tank 104.

System 200 is also shown to include at least one lower temperature sensor 206, at least one upper temperature sensor 208, and at least one output temperature sensor 210. As described herein, any of lower temperature sensor 206, upper temperature sensor 208, and output temperature sensor 210 may include one or more individual temperature sensing devices, such as thermocouples, thermistors, resistance temperature detectors (RTDs), integrated circuits (ICs), or the like. Output temperature sensor 210, for example, may include one or more temperature sensing devices positioned near an output of hybrid water heater 100 (e.g., at or near hot water outlet 126) and configured to measure an output water temperature from hybrid water heater 100. Data from output temperature sensor 210 may be used to monitor the output water temperature from hybrid water heater 100 to ensure that hybrid water heater 100 meets an output temperature setpoint. For a residential water heater, for example, hybrid water heater 100 may be configured to output hot water between 120° F. and 150° F., although it will be appreciated that this temperature range is not intended to be limiting. In various implementations, the output temperature sensor 210 may be omitted.

Lower temperature sensor 206 include one or more temperature sensing devices positioned in the lower portion 202 of storage tank 104. Accordingly, lower temperature sensor 206 may be configured to measure a temperature of the water in the lower portion 202 of storage tank 104. Likewise, upper temperature sensor 208 include one or more temperature sensing devices positioned in the upper portion 204 of storage tank 104. Accordingly, upper temperature sensor 208 may be configured to measure a temperature of the water in the upper portion 204 of storage tank 104. Thus, as described in greater detail below, upper temperature sensor 208 may be used to check the output water temperature from tankless heater 102. Additionally, data from both lower temperature sensor 206 and upper temperature sensor 208 may be compared to determine a water temperature gradient and/or an average water temperature of the water within storage tank 104.

In the example shown in FIG. 2, the upper temperature sensor 208 may be positioned proximate to a hot water supply from the tankless water heater 102. In other implementations, the upper temperature sensor 208 may be positioned apart from (e.g., opposite from or radially more than 25 degrees from the hot water supply from the tankless water heater 102). The upper temperature sensor 208 may alternatively or additionally be positioned above or below the hot water supply from the tankless water heater 102. Therefore, the upper temperature sensor 208 may measure a temperature of water positioned within the upper portion 204 of the storage tank 104 as opposed to a temperature of the hot water supplied by the water heater 102.

In some embodiments, lower portion 202 of storage tank 104 receives cold water from a source, such as a water utility, a municipal water supply, a holding tank, or any other source of fresh water. In some embodiments, cold water from the source is mixed with recirculated water from building systems 212. Building systems 212 may include any devices or systems within a facility (e.g., a campus or building) that utilize hot water from system 200. For example, building systems 212 may include a plumbing system for a building that provides hot water to one or more faucets or other devices that utilize hot water. Many commercial plumbing systems, for example, recirculate unused hot water back to a water heater; however, this recirculated water is generally not at a desired output (e.g., hot water) temperature setpoint due to heat loss throughout the plumbing system. Thus, the recirculated water may be mixed with fresh water from the source and transferred into system 200 for heating. In some such embodiments, the recirculated and fresh water are mixed prior to entering lower portion 202 (e.g., at cold water inlet 106).

To produce hot water, the cold water in lower portion 202 of storage tank 104 may be transferred to tankless heater 102. For example, a pump (e.g., recovery pump 118) may be activated that transfers cold water from lower portion 202 through tankless heater 102 for heating. As briefly described above, tankless heater 102 may heat the water using one or more heating elements. In some embodiments, tankless heater 102 includes one or more gas burners that burn a fuel, such as propane or natural gas, to heat the water. In some embodiments, tankless heater 102 includes one or more electrical heating elements that convert electrical energy into heat for heating the water. In either case, tankless heater 102 may be configured to heat the water using the heating elements to a desired output temperature setpoint. For example, the tankless heater 102 may heat the water to 140° F.; although the output temperature setpoint may be variable and/or user defined, as described in greater detail below.

Once the water is heated to the desired temperature setpoint, the hot water may be transferred to the upper portion 204 of storage tank 104. "Hot" water may refer to water at a wide range of temperatures; however, while not intended to be limiting, hot water as described herein may generally be at or above 100° F. More generally, "hot" water may refer to water that has been heated by the tankless water heater 102. Once in storage tank 104, the hot water may mix with a least a portion of the water already in storage tank 104, thereby raising the average temperature of the entire mass of water in storage tank 104. As described above, for example, the lower portion 202 of storage tank 104 may contain cold water from a source and/or recirculated water from buildings system 206, while the upper portion 204 of storage tank 104 may contain water that has been heated by heater 102. However, in some embodiments, the lower portion 202 and upper portion 204 of storage tank 104 are not separated by a physical barrier. Accordingly, all of the water (e.g., both heated and unheated) in storage tank 104 may be allowed to mix, creating a temperature gradient or difference within storage tank 104 such that the warmest water is nearest to the top of storage tank 104 and the coldest water is nearest to the bottom of storage tank 104.

To this end, positioning an outlet of storage tank 104 at the top surface of storage tank 104, as shown in FIGS. 1A and 1B, may allow building systems 212 to receive only hot water. As the hot water is transferred out of storage tank 104, fresh and recirculated water may be received and heated, thereby continuously replenishing the hot water leaving system 200. Accordingly, in some embodiments, the output temperature setpoint for tankless heater 102 may be higher (i.e., greater in value) than an output water temperature setpoint for system 200 to account for the mixing of various water temperatures in storage tank 104. For example, tankless heater 102 may heat water to 150° F. so that, after mixing with the cooler water in storage tank 104, building systems 212 may receive water that is at or near a desired temperature setpoint (e.g., 120° F.-140° F.).

Through this cycle of receiving cold/recirculated water in the lower portion 202 storage tank 104, heating the cold/recirculated water via tankless heater 102, and mixing the heated water with the existing water in the upper portion 204 of storage tank 104, the water in storage tank 104 may be maintained at or near (e.g., within a threshold of) a desired output water temperature setpoint. However, as mentioned above, building systems 212 may occasionally experience periods of increased hot water demand, in which case the hot water in the upper portion 204 of storage tank 104 is being transferred out of system 200 faster than it can be replenished by tankless heater 102. When this occurs, the temperature of the water in storage tank 104 may drop, as cold water from a source and/or recirculated water enters storage tank 104 to displace the hot water provided to building systems 212.

To compensate, tankless heater 102 may be allowed to operate at a higher output temperature setpoint (e.g., as compared to periods of "normal" or average hot water use). In other words, tankless heater 102 may heat water to a higher temperature than normal, such that when the hot water mixes with the water in storage tank 104, the average temperature of the water in storage tank 104 is raised to meet the desired system output temperature. As described in additional detail below, this output temperature setpoint control may be adaptive based on a number of factors, including the temperatures of the water in the lower portion 202 and the upper portion 204 of storage tank 104, as well as the output water temperature setpoint for system 200. Additionally, the effect of this adaptive setpoint control on the output water temperature of system 200 is described below in greater detail with respect to FIG. 6.

Adaptive Setpoint Control

Figure 3:
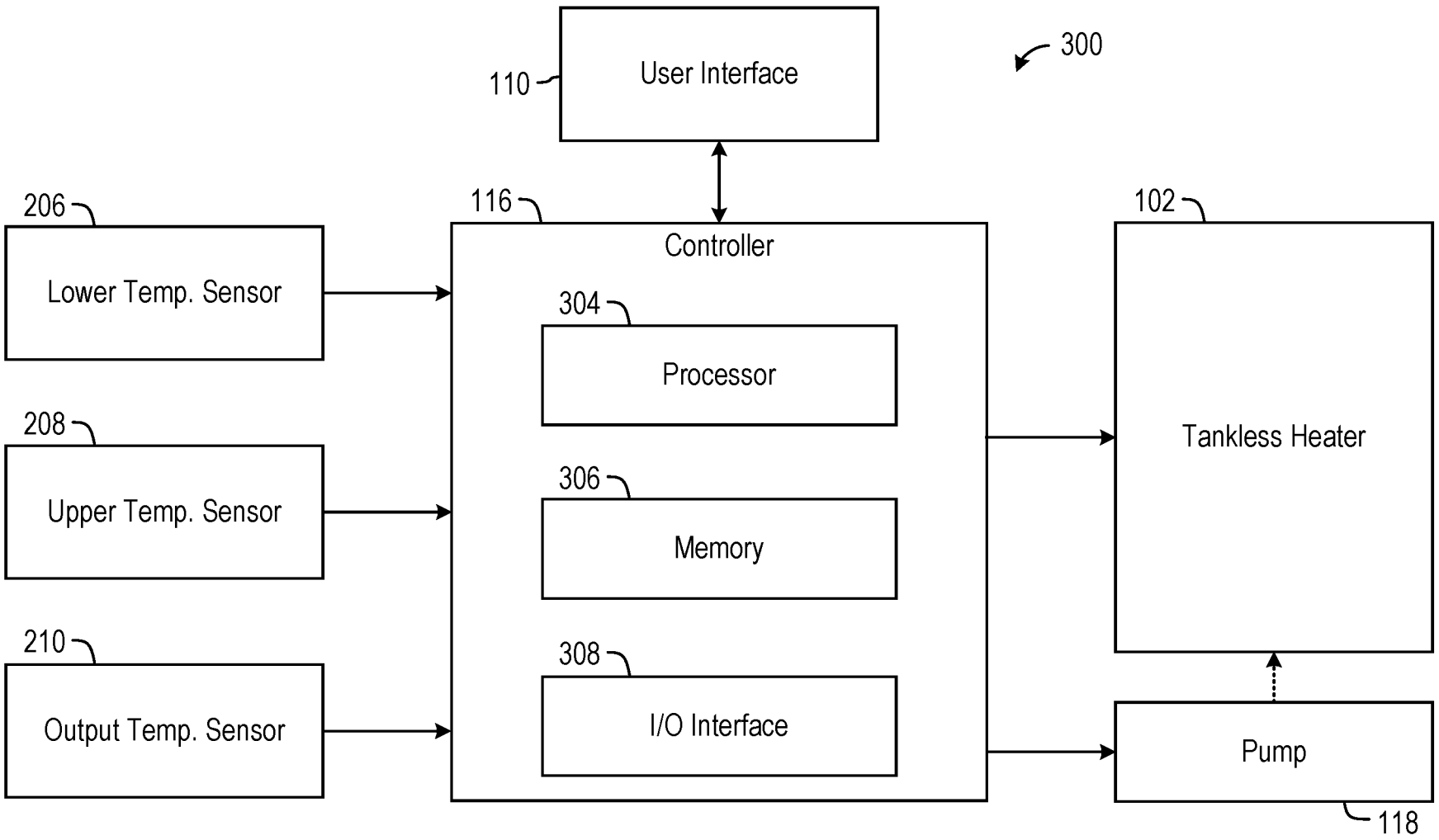
FIG. 3 is a diagram of a control system for a hybrid water heater, according to some embodiments.

Referring now to FIG. 3, a diagram of a control system 300 for hybrid water heater 100 is shown, according to some embodiments. Control system 300 may implement the adaptive setpoint control described briefly above with respect to FIG. 2 by varying the acceptable range of output temperatures for tankless heater 102. For example, control system 300 may increase or widen the acceptable range of output temperatures for tankless heater 102 responsive to a determination that the temperature of water stored in storage tank 104 has fallen below a threshold. In this way, tankless heater 102 may be allowed to produce water at a higher-than-normal temperature to stabilize the output water temperature of hybrid water heater 100 at or near a temperature setpoint. It will be appreciated that control system 300 may be equally functional when used in system 200. For example, as described above, system 200 may include hybrid water heater 100. Accordingly, control system 300 may be described herein with respect to one or both of hybrid water heater 100 and system 200, which is not intended to be limiting.

Control system 300 is shown to include controller 116, which itself includes a processor 304, memory 306, and an input/output (I/O) interface 308. Processor 304 can be a general-purpose processor, an application specific integrated circuit (ASIC), one or more field programmable gate arrays (FPGAs), a group of processing components, or other suitable electronic processing components. In some embodiments, processor 304 is configured to execute program code stored on memory 306 to cause controller 116 to perform one or more operations as described herein. Memory 306 can include one or more devices (e.g., memory units, memory devices, storage devices, etc.) for storing data and/or computer code for completing and/or facilitating the various processes described in the present disclosure. Memory 306 can be communicably connected to processor 304, such as via processing circuit (not shown), and can include computer code for executing (e.g., by processor 304) one or more processes described herein.

In some embodiments, memory 306 includes tangible, computer-readable media that stores code or instructions executable by processor 304. Tangible, computer-readable media refers to any media that is capable of providing data that causes controller 116 to operate in a particular fashion. Example tangible, computer-readable media may include, but is not limited to, volatile media, non-volatile media, removable media and non-removable media implemented in any method or technology for storage of information such as computer readable instructions, data structures, program modules or other data. Accordingly, memory 306 can include random access memory (RAM), read-only memory (ROM), hard drive storage, temporary storage, non-volatile memory, flash memory, optical memory, or any other suitable memory for storing software objects and/or computer instructions. Memory 306 can include database components, object code components, script components, or any other type of information structure for supporting the various activities and information structures described in the present disclosure.

While shown as individual components, it will be appreciated that processor 304 and/or memory 306 can be implemented using a variety of different types and quantities of processors and memory. For example, processor 304 may represent a single processing device or multiple processing devices. Similarly, memory 306 may represent a single memory device or multiple memory devices. Additionally, in some embodiments, controller 116 may be implemented within a single computing device (e.g., one server, one housing, etc.). In other embodiments controller 116 may be distributed across multiple servers or computers (e.g., that can exist in distributed locations). For example, controller 116 may include multiple distributed computing devices (e.g., multiple processors and/or memory devices) in communication with each other that collaborate to perform operations. In another example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers.

I/O interface 308 may facilitate communications between controller 116 and any external components or devices. For example, I/O interface 308 can communicate with (i.e., receive data from and/or transmitting data to) any of tankless heater 102, recovery pump 118, and/or user interface 110. Additionally, I/O interface 308 may receive data from a plurality of sensors positioned at various points on hybrid water heater 100, as described in greater detail below. Accordingly, I/O interface 308 can be or can include a wired or wireless communications interface (e.g., jacks, antennas, transmitters, receivers, transceivers, wire terminals, etc.) for conducting data communications. In some embodiments, I/O interface 308 may also provide power to various external components.

In various embodiments, communications via I/O interface 308 may be direct (e.g., local wired or wireless communications) or via a network (e.g., a WAN, the Internet, a cellular network, etc.). For example, I/O interface 308 can include a WiFi transceiver for communicating via a wireless communications network. In another example, I/O interface 308 may include cellular or mobile phone communications transceivers. In yet another example, I/O interface 308 may include a low-power or short-range wireless transceiver (e.g., Bluetooth®). Thus, it will be appreciated that I/O interface 308 may be configured to transmit and receive data by any suitable means and/or on any suitable try of network.

As briefly described above, user interface 110 may be any computing device that is operable by a user to interact with controller 110. Generally, user interface 110 may include a screen for displaying images and text and, in some embodiments, an input device (e.g., a mouse, a keyboard, a keypad, a touchscreen, etc.) for receiving user inputs. For example, user interface 110 may be positioned on an exterior surface of tankless heater 102 or storage tank 104 and may display data such as a temperature setpoint, error codes, current temperature readings, etc. Additionally, user interface may include on or more buttons that allow the user to adjust temperature setpoints, view and clear error codes, etc. In other embodiments, user interface 110 may be separate from tankless heater 102 and/or storage tank 104. For example, user interface 110 may be implemented on an external computing device, such as a smartphone, a tablet, a computer, etc. In such embodiments, a user may be able to interact with controller 116 without being physically near to hybrid water heater 100.

Still referring to FIG. 3, controller 116 may be configured to receive water temperature data from lower temperature sensor 206, upper temperature sensor 208, and output temperature sensor 210. The data received from these sensors can include individual temperature data from the lower portion 202 and upper portion 204 of storage tank 104, as well as output water temperature data for hybrid water heater 100. Using the temperature sensor data, controller 116 may be configured to determine whether the water in one or both of the lower portion 202 and the upper portion 204 meets various temperature setpoints. In particular, the water temperature in the lower portion 202 may be used to determine when to activate recovery pump 118, thereby transferring water through tankless heater 102 for heating. For example, the measured water temperature in the lower portion 202 of storage tank 104 may be compared to a temperature setpoint for hybrid water heater 100 and, if the measured water temperature is below a first threshold (e.g., 10° F. below the temperature), controller 116 may be configured to activate recovery pump 118. In this manner, heated water may be added to storage tank 104 to displace an amount of the cooler water in the lower portion 202, thereby raising the average water temperature in storage tank 104 to meet the setpoint.

In some embodiments, water temperature data from the upper portion 204 of storage tank 104 is utilized to adaptively control tankless heater 102. Specifically, controller 116 may evaluate temperature data received from upper temperature sensor 208 to determine whether the water temperature in the upper portion 204 meets or exceeds a minimum temperature (i.e., a lower threshold). If the water in the upper portion 204 is at or above the minimum temperature, then tankless heater 102 may operate under "normal" conditions. In other words, tankless heater 102 may be configured to produce heated water within a first allowable output temperature range (i.e., with a first allowable error). The first allowable output temperature range may be defined by a lower and an upper threshold temperature, which are typically centered around the temperature setpoint for hybrid water heater 100. For example, under normal operating conditions, tankless heater 102 may be allowed to produce heated water that is within 2° F. of the temperature setpoint (i.e., ±2° F.).

Under certain conditions, such as during periods of increased hot water demand, operating tankless heater 102 within the first allowable output temperature range is not sufficient to replenish the hot water being transferred out of hybrid water heater 100. Additionally, as described above, the temperature of the water being heated by tankless heater 102 may be variable based on the temperatures of the water provided by the source and the recirculated water received from building systems 212. Controller 116 may be configured to evaluate temperature data received from upper temperature sensor 208 to identify these types of "abnormal" conditions. Specifically, controller 116 may determine that the water temperature in the upper portion 204 is below the minimum temperature and, in response, may generate a second allowable output temperature range. Generally, the allowable output temperature range may be greater or wider than the first allowable output temperature range. In other words, the lower threshold of the second allowable output temperature range may be less than the lower threshold of the first allowable output temperature range, and the upper threshold of the second allowable output temperature range may be greater than the upper threshold of the first allowable output temperature range.

As an example, tankless heater 102 may be configured to produce heated water at 140° F. Under normal conditions, the output water temperature of tankless heater 102 may be considered to meet this temperature setpoint at anywhere between 138° F. and 142° F. (i.e., ±2° F.). To ensure that the water is being heated to this temperature range, tankless heater 102 may be configured to modulate the amount of heat provided by one or more heating elements. For example, tankless heater 102 may increase the amount of fuel provided to gas-burning elements to increase the output (e.g., BTUs) of the elements, thereby heating the water more quickly. In some embodiments, controller 116 is also configured to modulate the speed at which recovery pump 118 transfers water through tankless heater 102 to meet this temperature range.

When the water temperature in the upper portion 204 of storage tank 104 is below the minimum temperature, however, controller 116 may increase the allowable temperature range surrounding the temperature setpoint. For example, under these "abnormal" conditions, the output water temperature of tankless heater 102 may be considered to meet the temperature setpoint at anywhere between 132° F. and 148° F. (i.e., ±8° F.). In this regard, tankless heater 102 may be allowed to overshoot the normal upper temperature setpoint threshold (e.g., 142° F.) by about 6° F. This increase in maximum output temperature may allow tankless heater 102, and thereby hybrid water heater 100, to keep up with increased demand. Because the hotter than normal water supplied by the tankless heater 102 is mixed with the cool water in the storage tank 104, the water ultimately supplied to the hot water outlet 126 is approximately at the desired setpoint temperature.

In some embodiments, the minimum temperature discussed above is variable based on a temperature setpoint for the system (e.g., hybrid water heater 100 and/or system 200). For example, the minimum temperature may be defined as the difference between the output water temperature system and a predefined temperature variable (e.g., 20° F.). In some embodiments, the predefined temperature variable is set by a user (e.g., via user interface 110). In other embodiments, the predefined temperature variable is a known or preset system value. For example, the predefined temperature variable may be programmed into controller 116 during manufacturing. Additional details regarding the adaptive setpoint control process implemented by control system 300 are described in greater detail below.

Figure 4A:
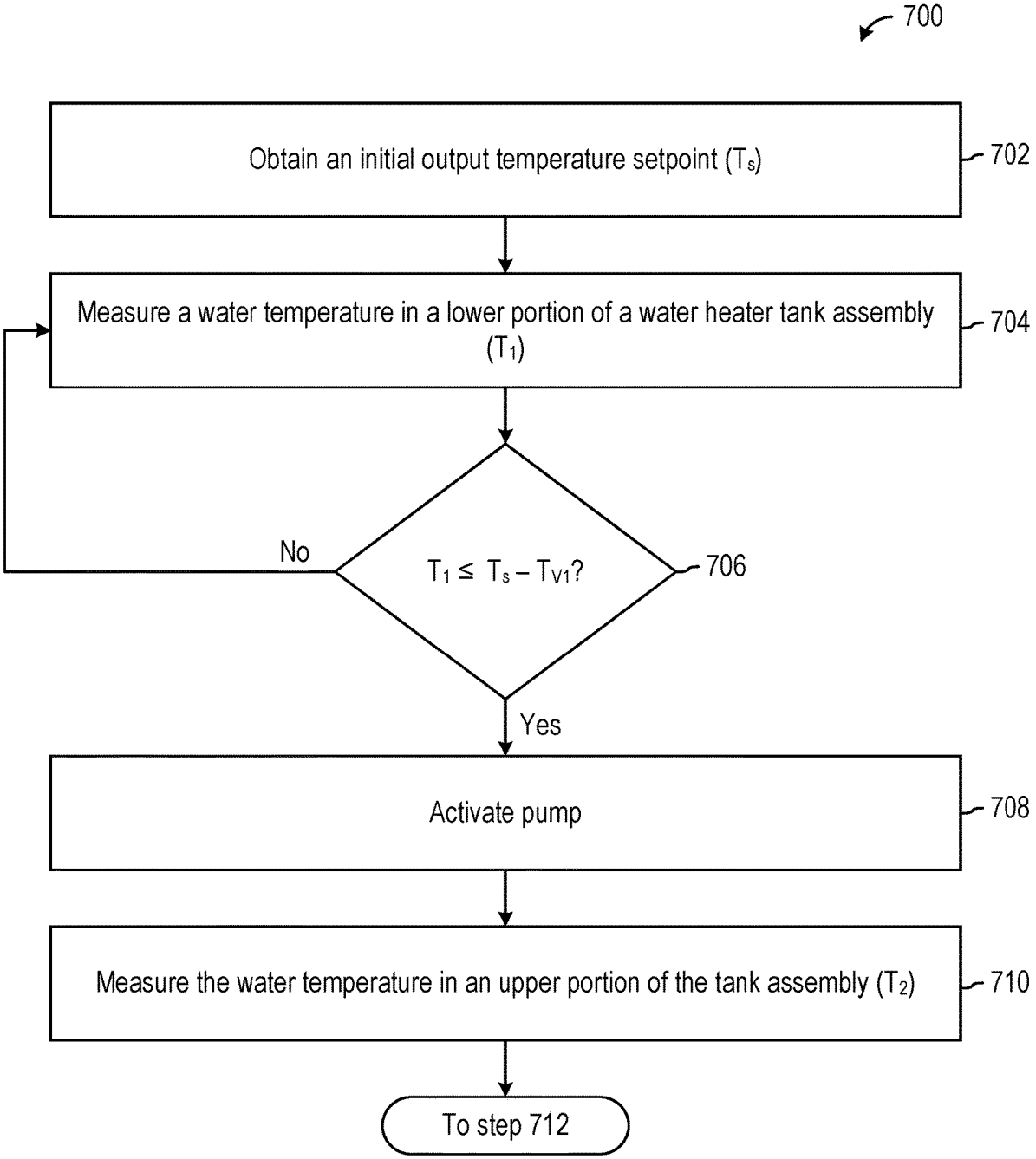
FIGS. 4A and 4B are a process for controlling an output temperature of a hybrid water heater based on an adaptive temperature setpoint, according to some embodiments.
Figure 4B:
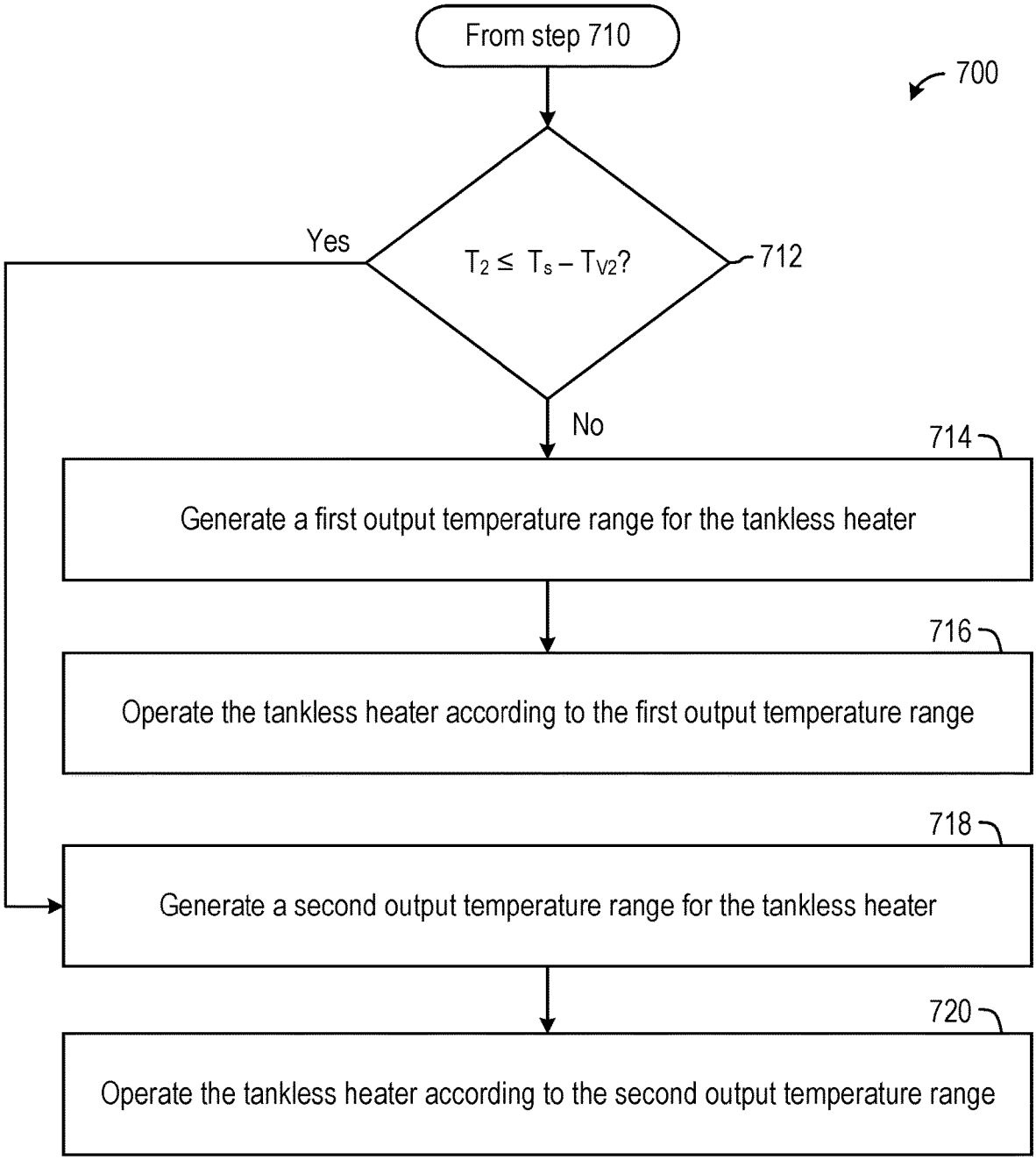

Referring now to FIGS. 4A and 4B, a process 400 for controlling an output temperature of a hybrid water heater based on an adaptive temperature setpoint is shown, according to some embodiments. Process 400 may be implemented by control system 300, for example. More specifically, controller 116 may be configured to perform at least a portion of the steps of process 400 outlined below. Process 400 may, advantageously, allow controller 116 to adapt the output temperature setpoint range for tankless heater 102 in order to meet an output temperature setpoint for hybrid heater 100 under varying conditions. It will also be appreciated that certain steps of process 400 may be optional and, in some embodiments, process 400 may be implemented using less than all of the steps.

At step 702, an initial output temperature setpoint, $T_s$, is obtained. In particular, $T_s$ may be a temperature setpoint for the hot water that is being provide to an external plumbing system (e.g., building systems 212) by a hybrid water heater (e.g., hybrid water heater 100). As mentioned above, for example, a residential water heater be set to an output temperature setpoint between 120° F. and 150° F., although it will be appreciated that this temperature range is not intended to be limiting. In other implementations, such as commercial applications, $T_s$ may be greater than or less than this range. In some embodiments, $T_s$ is predefined or preset, such as by a manufacturer at the time the hybrid water heater is produced. In some other embodiments, $T_s$ is set by a user or an installer of the hybrid water heater. For example, the user may set or adjust $T_s$ via a user interface (e.g., user interface 110), such as a keypad, a dial, a set of switches, etc.

At step 704, a water temperature in a lower portion of the hybrid water heater's tank assembly, $T_1$, is measured. As shown in FIG. 2, for example, $T_1$ may be measured by at least one temperature sensor positioned in the lower portion of the hybrid water heater's tank assembly. In some embodiments, the temperature sensor is configured to transmit a signal, such as a voltage, to a controller (e.g., controller 116), which the controller may convert to a temperature measurement.

At step 706, a determination is made as to whether $T_1$ is equal to or less than a first minimum temperature. The first minimum temperature may be defined as:

$$T_s - T_{V1} \tag{1}$$

where $T_s$ is the initial output temperature setpoint obtained at step 702 and $T_{V1}$ is a temperature variable. Accordingly, the comparison between $T_1$ and the first minimum temperature may be evaluated as:

$$T_1 \leq T_s - T_{V1} \tag{2}$$

In some embodiments, $T_{V1}$ is obtained from a user interface, similar to $T_s$. In other embodiments, $T_{V1}$ is predefined, such as by a manufacturer or installer of the hybrid water heater. For example, $T_{V1}$ may be a set value programmed to controller 116 prior to operation. In some embodiments, $T_{V1}$ varies based on factors such as the output (e.g., in BTUs) of a tankless heater of the hybrid water heater or based on a specific application. For example, in a commercial application, $T_{V1}$ may be greater in value than in a residential application. In one specific but non-limiting use-case example, $T_{V1}$ is set to 10° F.

Illustrated below is another non-limiting use-case example in which $T_1$, which is measured at 110° F., is determined to be less than the first minimum temperature.

$$110° \text{ F.} \leq 135° \text{ F.} - 10° \text{ F.}$$

$$110° \text{ F.} \leq 125° \text{ F.}$$

Thus, in this example, process 700 continues to step 708. Alternatively, if $T_1$ is at or above the first minimum temperature (e.g., if $T_1$ in the above example was at or above 125° F.), process 700 may revert back to step 704. In other words, the controller can continuously check the temperature in the lower portion of the storage tank such that process 700 only continues past step 706 in the event that $T_1$ is below the first minimum temperature.

At step 708, a pump (e.g., recovery pump 118) that transfers water from the lower portion of the storage tank through a tankless heater an into the upper portion of the storage tank is activated. For example, the controller may send a control signal to the pump to turn the pump on and/or to adjust a speed of the pump, thereby causing water to flow from the lower portion of the storage tank through the tankless heater to be heated. After being heated, the water may then be transferred to the upper portion of the storage tank, where it can mix with previously-heated water, fresh water, and recirculated water already in the storage tank. Under normal conditions, the tankless heater may heat the water (e.g., as it's being pumped through the tankless heater) to within a first output temperature range. As mentioned above, the first output temperature range may include a lower threshold and an upper threshold surrounding $T_s$. For example, the first output temperature range may be ±2° F. of $T_s$. Thus, in the example above, the output temperature range may be 133° F. to 137° F.

At step 710, a water temperature in the upper portion of the hybrid water heater's tank assembly, $T_2$, is measured. As shown in FIG. 2, for example, $T_2$ may be measured by at least one temperature sensor positioned in the upper portion of the hybrid water heater's tank assembly. Subsequently, at step 712, a determination is made as to whether $T_2$ is equal to or less than a second minimum temperature. The second minimum temperature may be defined as:

$$T_s - T_{V2} \tag{3}$$

where $T_s$ is the initial output temperature setpoint obtained at step 702 and $T_{V2}$ is a temperature variable (e.g., similar to $T_{V1}$). Accordingly, the comparison between $T_1$ and the first minimum temperature may be evaluated as:

$$T_2 \leq T_s - T_{V2} \tag{4}$$

Like $T_{V1}$, $T_{V2}$ may be obtained from a user interface or may be predefine by a manufacturer or installer of the hybrid water heater. For example, $T_{V2}$ may be a set value programmed to controller 116 prior to operation. In some embodiments, $T_{V2}$ varies based on factors such as the output (e.g., in BTUs) of a tankless heater of the hybrid water heater or based on a specific application. For example, in a commercial application, $T_{V2}$ may be greater in value than in a residential application. In one specific but non-limiting use-case example, $T_{V2}$ is set to 20° F.; however, for gas-fuel tankless heaters, $T_{V2}$ may also be dependent on the type of venting used. For example, $T_{V2}$ may be set to 10° F. for B-vent style tankless heaters. In such embodiments, $T_{V1}$ may be set to a value that is less than the value $T_{V2}$. For example, if $T_{V2}$ is 10° F., then $T_{V1}$ may be set to 5° F.

Continuing the example use-case from above, the second minimum temperature may be defined as:

$$135° \text{ F.} - 20° \text{ F.} = 115° \text{ F.}$$

Accordingly, if $T_1$ is measured at 110° F., then $T_1$ is less than the second minimum temperature. In this case, process 700 may continue to step 718, described in detail below. However, if $T_1$ is measured at 125° F., then $T_1$ is not less than or equal to the second minimum temperature and process 700 continues to step 714.

At step 714, a first output temperature range is generated or defined for the tankless heater. In general, the first output temperature range may be considered a "normal" operating range for the tankless heater because, at step 712, it was determined that the water temperature in the upper portion of the storage tank is at or above the second minimum temperature. The first output temperature range may include a lower threshold and an upper threshold that are generally evenly spaced from $T_s$. In some embodiments, the lower threshold and upper thresholds are the same absolute value. For example, the first output temperature range may be defined as $T_s \pm T_{threshold}$, where $T_{threshold}$ is a value of the lower threshold and upper thresholds. Using the value of $T_s$ from the examples above and an example $T_{threshold}$ of 2° F., for example, the first output temperature range may be 135° F.±2° F., or 133° F. to 137° F.

At step 716, the tankless heater is operated according to the first output temperature range. Specifically, the tankless heater may be controlled (e.g., by transmitting control signals from a controller) to ensure that the water passing through the tankless heater is heated to within the first output temperature range. For example, a control signal may be transmitted to the tankless heater that causes the tankless heater to increase or decrease the thermal energy output by one or more heating elements. In a gas-fueled tankless heater, for example, an amount of fuel provided to the gas-powered heating elements may be modulated to meet the first output temperature range. In some embodiments, the pump (e.g., recovery pump 118) is also operated based on the first output temperature range. For example, a speed of the pump may be increased or decreased to ensure that the water in the tankless heater is heated to within the first output temperature range. In some embodiments, a temperature of the water that is output from the tankless heater may be measured to ensure that the water is within first output temperature range.

At step 718, a second output temperature range is generated or defined for the tankless heater. The second output temperature range may be an adjusted operating range for the tankless heater because, at step 712, it was determined that the water temperature in the upper portion of the storage tank is less than the second minimum temperature. The second output temperature range may include a lower threshold and an upper threshold that are generally evenly spaced from $T_s$. In some embodiments, the lower threshold and upper thresholds are the same absolute value. For example, the second output temperature range may be defined as $T_s \pm T_{threshold}$, where $T_{threshold}$ is a value of the lower threshold and upper thresholds. Using the value of $T_s$ from the examples above and an example $T_{threshold}$ of 10° F., for example, the second output temperature range may be 135° F.±10° F., or 125° F. to 145° F. Specifically, in some embodiments, the lower threshold of the second output temperature range is between 10° F. and 20° F. less than and the upper threshold of the second output temperature range is between 10° F. and 20° F. greater than $T_s$.

Generally, the second output temperature range may be "wider" than the first output temperature range. Specifically, the lower and upper thresholds of the second output temperature range may be greater in absolute value than the lower and upper thresholds of the first output temperature range. Put another way, the lower threshold of the second output temperature range is generally less than the lower threshold of the first output temperature range, and the upper threshold of the second output temperature range is generally greater than the upper threshold of the first output temperature range.

Referring once again to the examples above, it is clear that the first output temperature range of 135° F.±2° F., or 133° F. to 137° F., is much narrower than the second output temperature range of 135° F.±10° F., or 125° F. to 145° F. In this regard, operating in the second output temperature range allows the tankless heater to heat water to a much higher temperature than normal, which may allow the tankless water heater to compensate for lower-than-normal water temperatures in the storage tank of the hybrid water heater due to, for example, increased hot water demand or fluctuations in received water temperature. In some embodiments, the second output temperature range is between ±8° F. and ±12° F. from $T_s$.

At step 720, the tankless heater is operated according to the second output temperature range. Specifically, the tankless heater may be controlled to ensure that the water passing through the tankless heater is heated to within the second output temperature range, such as by causing (e.g., via a control signal) the tankless heater to increase or decrease the thermal energy output by one or more heating elements. For example, an amount of fuel or electricity provided to the heating elements of the tankless heater may be modulated to meet the second output temperature range. In some embodiments, the pump (e.g., recovery pump 118) is also operated based on the second output temperature range.

Figure 5:
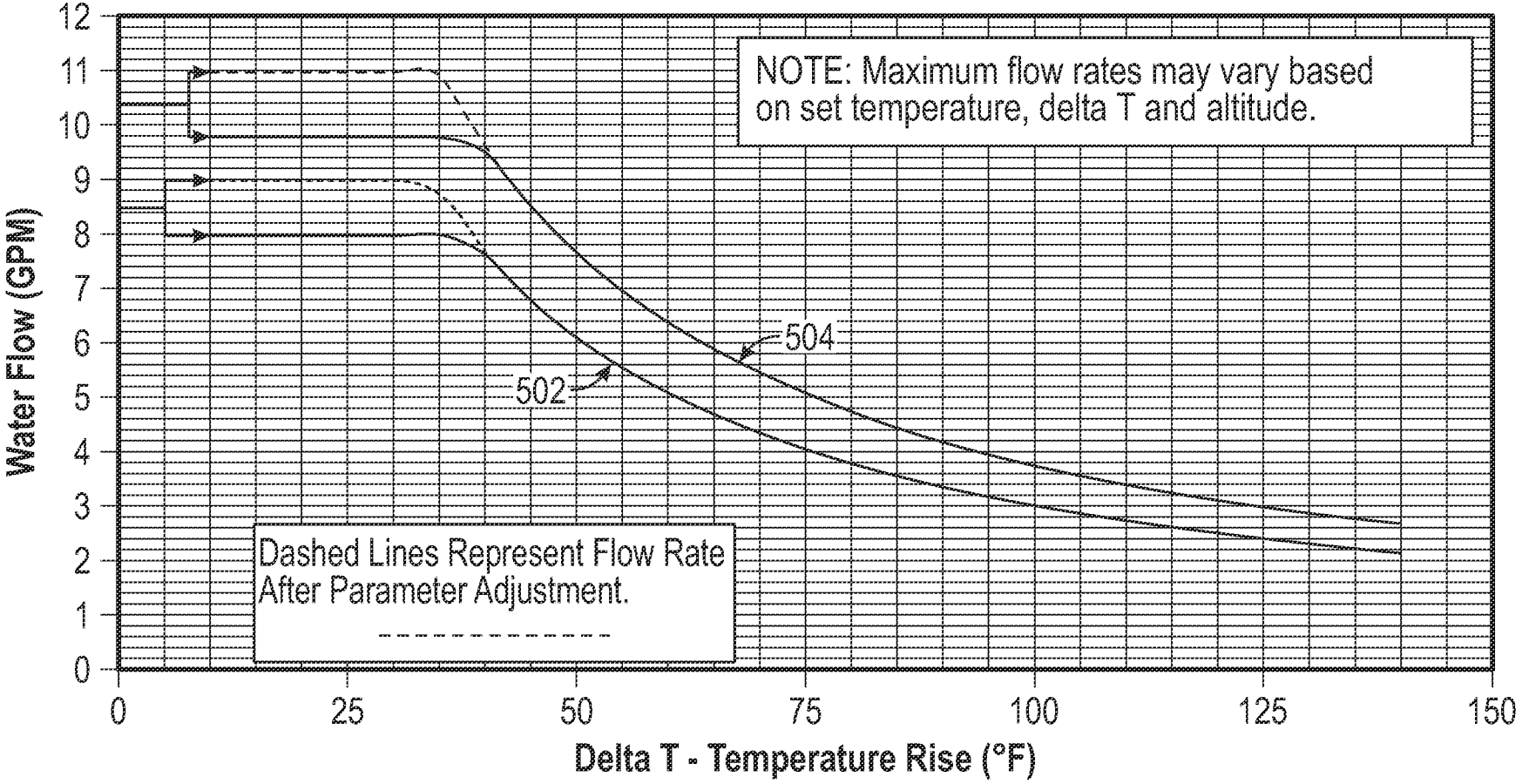
FIG. 5 is an example graph illustrating maximum water flow rates versus temperature rise, according to some embodiments.

Referring now to FIG. 5, an example graph illustrating maximum water flow rates versus temperature rise is shown, according to some embodiments. Specifically, the graph includes two curves defining the flow rate in GPM versus the temperature rise, ΔT, for two different types of tankless water heaters. A first curve 502 may represent the flow rate versus ΔT for a tankless heater capable of a first thermal energy output (e.g., in BTU), while a second curve 504 may represent the flow rate versus ΔT for a tankless heater capable of a second thermal energy output. In this example, the tankless heater associated with second curve 504 may have a higher BTU output, or thermal output rating, than the tankless heater associated with first curve 502.

From the graph, it can be seen that that the flow rate of each tankless heater generally decreases as ΔT increases. As described herein, ΔT represents a number of degrees of temperature that the tankless heater can raise the temperature of water at a given flow rate. For example, second curve 504 shows that the associated tankless heater can raise the temperature of water 75° F. at 5 GPM. However, if the temperature of the water needs be raised 100° F., the tankless heater is limited to about 3.8 GPM. In other words, FIG. 5 shows that flow rate and ΔT are correlated for tankless water heaters. Accordingly, if one where to increase the flow rate of the tankless heater associated with second curve 504, for example, the amount of heat that can be added to the water must necessarily drop.

However, as shown in the left-hand side of the graph, adjusting the output temperature range for a tankless heater may result in a greater flow rate for certain ΔTs. Taking first curve 502, for example, adjusting the output temperature range using process 400, described above, may allow the tankless heater to heat a greater quantity of water while achieving the same temperature rise. In this example, the tankless heater associated with first curve 502 is shown to be able to heat 9 GPM of water, rather than 8 GPM, for a ΔT between about 10° F. and 30° F. when operating using an adjusted (e.g., wider) output temperature range.

Figure 6:
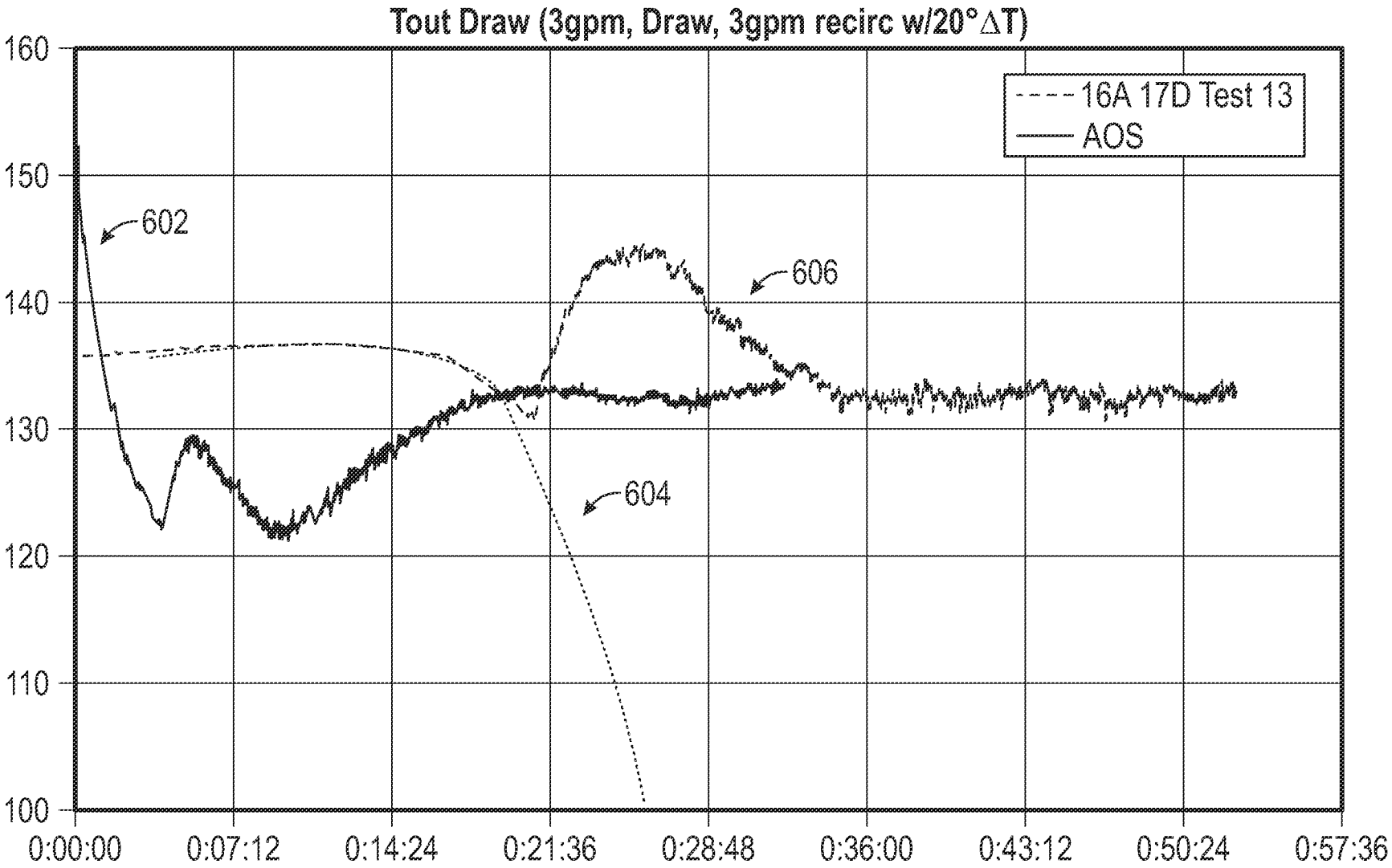
FIG. 6 is an example graph illustrating the temperature response of a hybrid water heater utilizing the control system of FIG. 3, according to some embodiments.

Referring now to FIG. 6, an example graph illustrating the temperature response of hybrid water heater 100 is shown, according to some embodiments. More generally, the graph of FIG. 6 shows the output water temperatures of three different types of water heaters over time, including hybrid water heater 100. A first line 602, for example, may represent the temperature response over time of a more traditional storage tank water heater. As shown, the output water temperature of the storage tank water heater quickly drops to between 120° F. and 130° F., and takes roughly 20 minutes to stabilize to a temperature of approximately 132° F. However, at around 10 minutes, the output water temperature of the storage tank water heater hits a minimum temperature of about 122° F., which is about 10° F. below the steady-state temperature of 132° F.

A second line 604 may illustrate the temperature response of a hybrid water heater that does not include an upper temperature sensor, as in hybrid water heater 100, nor that implements the adaptive setpoint control of process 400. It can be seen that the non-adaptive hybrid water heater maintains a relatively steady output water temperature of about 137° F. for about 18 minutes. However, the output water temperature of the non-adaptive hybrid water heater quickly drops off to less than 100° F. at about 24 minutes. Additionally, FIG. 5 shows that the non-adaptive hybrid water heater may not recover to an acceptable output water temperature.

In contrast, a third line 606 illustrates the temperature response of hybrid water heater 100, which includes an upper temperature sensor, and which implements the adaptive setpoint control of process 400. Accordingly, hybrid water heater 100 is shown to maintain a relatively steady output water temperature of about 137° F. for about 18 minutes, before the output water temperature begins to decline to about 131° F. Unlike the storage tank water heater and non-adaptive hybrid water heater described above, however, hybrid water heater 100 is shown to quickly recover to an output water temperature of about 144° F. by 24 minutes, eventually settling out to a steady-state of about 132° F. from 34 minutes onward. In this regard, FIG. 5 shows that the adaptive setpoint control process implemented by hybrid water heater 100 provides hybrid water heater 100 with a much more accurate and consistent output water temperature that exceeds the performance of a traditional storage tank water heater, while also providing many of the advantages of tankless water heaters as described above.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions, and arrangement of the exemplary embodiments without departing from the scope of the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures, and which can be accessed by a general purpose or special purpose computer or other machine with a processor.

When information is transferred or provided over a network or another communications connection (either hardwired, wireless, or a combination of hardwired or wireless)

to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general-purpose computer, special purpose computer, or special purpose processing machines to perform a certain function or group of functions.

Although the figures show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

What is claimed is:

1. A system for heating water, the system comprising:

a storage tank having a lower portion and an upper portion, the lower portion comprising a first inlet for receiving water from a source and the upper portion comprising a first outlet for providing hot water to a building system;

a first temperature sensor positioned in the upper portion of the storage tank;

a tankless heater for producing heated water and providing the heated water to the upper portion of the storage tank, the tankless heater comprising a second outlet for fluidly coupling the tankless heater to the storage tank; and a controller configured to:

determine a target output temperature range for the tankless heater based on a temperature setpoint, the target output temperature range comprising a lower threshold that is less than the temperature setpoint and an upper threshold that is greater than the temperature setpoint;

measure a temperature of the hot water stored in the upper portion of the storage tank using the first temperature sensor;

determine whether the measured temperature of the hot water is less than a first minimum temperature;

generate an adjusted target output temperature range for the tankless heater based on a determination that the measured temperature is less than the first minimum temperature by increasing a value of both the lower threshold and the upper threshold; and control the tankless heater to produce the heated water according to the adjusted target output temperature range.

2. The system of claim 1, further comprising a pump positioned between the storage tank and the tankless heater, the pump configured to transfer water from the lower portion of the storage tank to the tankless heater.

3. The system of claim 2, further comprising a second temperature sensor positioned in the lower portion of the storage tank, the controller further configured to:

measure a water temperature in the lower portion of the storage tank using the second temperature sensor; and activate the pump responsive to a determination that the water temperature in the lower portion of the storage tank is below a second minimum temperature, wherein a value of the first minimum temperature is lower than a value of the second minimum temperature.

4. The system of claim 1, wherein the first inlet of the storage tank is configured to receive recirculated water from the building system, wherein the recirculated water mixes with the hot water stored in the storage tank and the water received from the source.

5. The system of claim 1, wherein:

the lower threshold of the adjusted target output temperature range is between 10 and 20° F. less than the temperature setpoint; and the upper threshold of the adjusted target output temperature range is between 10 and 20° F. greater than the temperature setpoint.

6. The system of claim 1, the controller further configured to calculate the first minimum temperature by subtracting a predefined temperature variable from the temperature setpoint.

7. The system of claim 6, further comprising a user interface for receiving a user input defining the temperature setpoint.

8. The system of claim 1, the tankless heater further comprising a second inlet for receiving the cold water from the lower portion of the storage tank.

9. The system of claim 1, wherein the tankless heater is mounted to an exterior surface of the storage tank.

10. A method for controlling a hybrid water heater comprising a storage tank for holding water and a tankless heater fluidly coupled to the storage tank for producing heated water, the method comprising:

determining a target output water temperature range for the tankless heater based on a temperature setpoint, the target output water temperature range comprising a lower threshold that is less than the temperature setpoint and an upper threshold that is greater than the temperature setpoint;

measuring, by a first temperature sensor positioned in an upper portion of the storage tank, a temperature of water stored in the upper portion of the storage tank;

determining whether the measured temperature of the water is less than a first minimum temperature;

generating an adjusted water target output temperature range for the tankless heater based on a determination that the measured temperature is less than the first minimum temperature by increasing a value of both the lower threshold and the upper threshold; and operating the tankless heater to produce the heated water according to the adjusted target output water temperature range.

11. The method of claim 10, the hybrid water heater further comprising a pump positioned between the storage tank and the tankless heater, the pump configured to transfer the water from a lower portion of the storage tank to the tankless heater.

12. The method of claim 11, further comprising:

measuring, by a second temperature sensor positioned in the lower portion of the storage tank, a water temperature in the lower portion of the storage tank; and activating the pump responsive to a determination that the water temperature in the lower portion of the storage tank is below a second minimum temperature, wherein a value of the first minimum temperature is lower than a value of the second minimum temperature.

13. The method of claim 10, further comprising receiving, by the storage tank, recirculated water from an external plumbing system, wherein the recirculated water mixes with the water stored in the storage tank and water received from a source.

14. The method of claim 10, wherein:

the lower threshold of the adjusted target output water temperature range is between 10 and 20° F. less than the temperature setpoint; and the upper threshold of the adjusted target output water temperature range is between 10 and 20° F. greater than the temperature setpoint.

15. The method of claim 10, further comprising calculating the first minimum temperature by subtracting a predefined temperature variable from the temperature setpoint.

16. The method of claim 10, further comprising receiving, from a user interface, a user input defining the temperature setpoint.

17. A water heater comprising:

a storage tank for holding water, the storage tank having a lower portion and an upper portion;

a tankless heater configured to produce heated water and to provide the heated water to the upper portion of the storage tank, the tankless heater positioned externally to the storage tank;

a first temperature sensor configured to measure a temperature of the water in the upper portion of the storage tank; and a controller configured to:

measure the temperature of the water stored in the upper portion of the storage tank using the first temperature sensor;

determine a target output water temperature range for the tankless heater based on the measured temperature, the target water output temperature range comprising i) a first lower threshold and a first upper threshold if the measured temperature is above a first minimum temperature, or ii) a second lower threshold and a second upper threshold if the measured temperature is at or below the first minimum temperature, wherein a value of the second lower threshold is less than a value of first lower threshold and a value of the second upper threshold is greater than a value of the first upper threshold; and operate the tankless heater to produce the heated water according to the target output water temperature range.

18. The water heater of claim 17, further comprising:

a second temperature sensor configured to measure a temperature of the water in the lower portion of the storage tank; and a pump configured to transfer the water from the lower portion of the storage tank through the tankless heater.

19. The water heater of claim 18, the controller further configured to:

measure a water temperature in the lower portion of the storage tank using the second temperature sensor; and activate the pump responsive to a determination that the water temperature in the lower portion of the storage tank is below a second minimum temperature, wherein a value of the first minimum temperature is lower than a value of the second minimum temperature.

20. The water heater of claim 17, wherein:

the second lower threshold of the target output water temperature range is between 10 and 20° F. less than a temperature setpoint; and the second upper threshold of the target output water temperature range is between 10 and 20° F. greater than a temperature setpoint.

* * * * *